US005651620A

United States Patent [19]

Paranjpe

[11] Patent Number: 5,651,620

[45] Date of Patent: Jul. 29, 1997

[54] NONIMPACT PRINTER HAVING SELECTABLE RIBBONS AND PRINT HEADS

[76] Inventor: Suresh C. Paranjpe, 2105 Ridge Point Dr., Lake Oswego, Oreg. 97034

[21] Appl. No.: 47,144

[22] Filed: Apr. 12, 1993

Related U.S. Application Data

[63] Continuation-in-part of Ser. No. 39,871, Mar. 30, 1993, Pat. No. 5,445,463.

[51] Int. Cl.[6] ..... B41J 2/00

[52] U.S. Cl. ..... 400/120.02; 400/120.11

[58] Field of Search ..... 400/120.02, 120.04, 400/249, 120.11, 605, 149; 346/46, 76 PH; 347/191, 192, 212, 214

[56] References Cited

U.S. PATENT DOCUMENTS

| | | | |
|---|---|---|---|
| 4,462,704 | 7/1984 | Kurata et al. | 400/120 |
| 4,815,872 | 3/1989 | Nagashima | 400/120 |
| 4,863,297 | 9/1989 | Fuji | 400/249 |
| 4,899,171 | 2/1990 | Ogura et al. | 346/76 PH |

FOREIGN PATENT DOCUMENTS

| | | |
|---|---|---|
| 57-129762 | 8/1982 | Japan . |
| 57-129761 | 8/1982 | Japan . |
| 58-148778 | 9/1983 | Japan . |
| 63-297079 | 12/1988 | Japan . |
| 64-72867 | 3/1989 | Japan . |
| 1-264885 | 10/1989 | Japan . |

*Primary Examiner*—Ren Yan

*Attorney, Agent, or Firm*—Marger Johnson McCollom & Stolowitz P.C.

[57] ABSTRACT

A nonimpact printer accommodates at least one ribbon of selected transfer panel types such as yellow, magenta, cyan and black thermal transfer or dye diffusion, precoat, overcoat, and the like, or combinations thereof, and may also include a direct energy printing assembly. At least one energy source provides energy for these printing processes and is independently selectable for use with a selected one or more of such ribbons or direct energy processes, based upon rotational or translational movement of the energy source followed by selective activation thereof. Means are also provided for identifying and utilizing unused transfer panels, or portions of such panels, so as to minimize wastage of ribbon.

16 Claims, 6 Drawing Sheets

NONIMPACT PRINTER HAVING SELECTABLE RIBBONS AND PRINT HEADS

RELATION TO OTHER APPLICATIONS

This application is a continuation in part of Appl. Ser. No. 08/039,871 filed Mar. 30, 1993, now U.S. Pat. No. 5,445,463.

BACKGROUND OF THE INVENTION

1. Field of the Invention

This invention relates to an image forming apparatus or nonimpact printer that applies one or more forms of energy to an ink or dye ribbon or the like to cause the transfer of a selected portion thereof to a substrate to form an image. More precisely, this invention relates to nonimpact printers that accommodate more than one ribbon at once, and especially printers that permit use of one or more energy sources with two or more ribbons, which can be of differing types, including various types of combination ribbons, and to means for switching from one ribbon or energy source to another in the course of a printing task. Also included are printers that accommodate direct energy printing along with processes that employ a transfer medium.

2. Background Information

In thermal transfer printing, an ink-bearing ribbon is pressed against a substrate between the thermal print head and a platen. The substrate can be ordinary or specially coated paper, or also plastic film, acetate and the like. Resistor elements in the print head are selectively subjected to a heating current, thereby causing the transfer of ink from the ribbon to the substrate in a desired pattern. In the analogous electroresistive process, the print head uses needle-like electrodes brought into contact with an electroresistive ink to cause such transfer. In either case, for black printing, a single long black ink ribbon can be used, or a single ribbon might include a multiplicity of black panels, each of the size (e.g., 8½×11 inches, legal size, or A4 etc.) of the substrate onto which the image is to be transferred. For color printing, three separate panels in the colors yellow, magenta, and cyan, typically arranged in repetitive units along the ribbon, are generally used. A full color image is obtained from the three primary colors by printing one color over the other, typically in the order yellow, magenta and cyan.

The three colors can also be superimposed to produce a black image, but such an image is usually not of the same quality as can be formed using a single black ink. To use three color panels to produce a black image is also wasteful of color panels, and increases the time required for the image transfer. To obtain the generally higher quality black image available from a black ribbon requires replacing the three-color ribbon with a black ribbon (and back again to do full color printing, etc.), and to avoid repetitive ribbon changing, ribbons have been developed in the prior art that include black panels in addition to the three color panels.

U.S. Patent Appl. Ser. No. 08/039,871 filed Mar. 30, 1993 entitled COMBINATION INK OR DYE RIBBON AND APPARATUS FOR NONIMPACT PRINTING by the inventor of the present invention describes "combination ribbons" which, in addition to three-color and black panels, also include different types of panels, e.g., thermal transfer, dye diffusion, electroresistive, and other types that are needed for different printing requirements. It thus becomes possible to carry out various kinds of printing using just one ribbon.

One disadvantage of the foregoing procedure, however, is that of needing to traverse through the ribbon in order to arrive at a black ink panel, move back again to do color printing, go back to the black panel or to another panel type, and so on. Such a process is wasteful of time and can be damaging to the ribbon. Moreover, the relative amounts of full color and black or other printing required may not coincide with the relative numbers of different panel colors or types on the ribbon, so that some portions of the ribbon may become wasted.

One solution of the foregoing problem has simply been to employ two printers: one having a three-color ribbon for full color printing, and another with a black ribbon for printing in black. However, that procedure introduces extra expense, and also requires additional desk space. Moreover, for images that require black printing along with full color printing, to obtain the higher quality black image from the black ink printer it becomes necessary to transfer the substrate onto which the image is to be placed from one printer to the other, and it may be difficult or impossible to obtain the same substrate alignment (i.e., image registration) in the one printer as in the other, so that the image transferred in the second printing will actually appear where desired relative to the first image. The alternative procedure of using just one printer but changing ribbons for each kind of printing process, while saving of expense and desk space, introduces even greater operator inconvenience.

Another type of thermal transfer printer has a back roller in lieu of a platen, so that the back roller faces against the thermal head with the ink donor sheet or ribbon and the recording sheet or receiving medium pressed therebetween as usual, but wherein the back roller is driven by a motor so as to advance both the ribbon and receiving medium. U.S. Pat. No. 4,495,507 issued Jan. 22, 1985 to Moriguchi et al. describes such a device that contains two complete "recording stations," i.e, two separately functioning back rollers, roller drive motors, thermal heads and ribbons (on associated supply and takeup rolls) wherein the two ribbons provide twocolor printing onto a receiving medium that is made to pass first through one recording station and then through the other. This "two-station" design also has registration problems, namely, that any difference in diameter between the two back rollers will cause differences in the rate of advance of the receiving medium in the two cases, thereby introducing a color shift in the transferred image. The Moriguchi et al. patent addresses that problem by using different drive motors so that one motor can compensate for such variations in the rate of medium advance, but even so, the use of two recording stations in a back roller device that advances both the ribbon and receiving medium does not resolve the problems discussed above, especially in that the Moriguchi et al. device is fixedly disposed whereby the receiving medium must pass through both stations whether or not such double printing is desired. (In the case that double printing was not desired, presumably the receiving medium and ribbon would be advanced in the second station as before but no signal would be sent to the print head, hence the amount of ribbon so advanced would be wasted.)

In U. S. Pat. No. 4,774,527 issued Sep. 27, 1988 to Hancock et al., a thermal print head is described that incorporates at least two oppositely facing columns of electrodes such that the print head can be removed and replaced in an oppositely facing direction when one column of electrodes has become worn out through use, or the two different columns may also have different sized electrodes for printing at different levels of resolution. The different sets of electrodes are connected to same-sized sets of conductors, and those conductors are alternatively connected to a samesized set of contact pads on a connecting cable, so that which set of electrodes is in use depends upon the orientation in which the print head is mounted in the printer, i.e., as to which set of conductors contacts those contact pads, whereby one or the other set of electrodes will also be brought into contact with the printing ribbon when the print head is mounted. Reversal of orientation of the print head requires removal thereof and reinstallation.

Another disadvantage of the Hancock et al. device is that although only one set of electrodes is being used at a time, the image signal is sent also to a second or more sets of electrodes, thus subjecting the same to thermal cycling from the image signal and causing unnecessary deterioration thereof. It would be preferable to provide a switching system that would connect the image signal only to the electrode set in use, and secondly to provide means for moving that structure into a selected position or orientation that places the desired set of electrodes at the image receiving medium for printing without the need to remove and reinstall the entire electrode structure.

In U.S. Pat. No. 4,626,870 issued Dec. 2, 1986 to Yamamoto et al., another print head is described that has two sets of thermal elements thereon, the two sets being of different resolution in terms of dots per inch. In this case, the print head is formed of two halves bent crosswise to a small (e.g., 3 degrees) dihedral angle at the center thereof, and the two sets of thermal elements are disposed on either side of the central bend line, either immediately adjacent thereto or symmetrically at opposite ends of the print head away from the central bend line. The print head is used so that the two sets of thermal elements are in contact with a thermal transfer ribbon at the same time, and one or the other set, and thus the resolution in which a character is printed, can be selected by appropriate electronic signals. Since the two sets of thermal elements have different lateral positions on the print head, it appears that the positioning of the print head relative to the thermal transfer ribbon, or more exactly in relation to a substrate onto which an image is to be transferred, must also be adjusted in selecting one or the other set of thermal elements.

In the prior art, two print heads and two ribbons have been used for two color printing. For full color printing, three color (y, m, c) ribbons have been used, or four color (y, m, c and black) ribbons for full color and black printing, and each of these procedures has had inherent registration problems. To help avoid those problems, and for the other purposes described herein, what is needed and would be useful is a method, within one printer, of using a y, m, c (and black) ribbon with good registration for full color (and black) printing in a single operation while also, when precise registration is not required, e.g., when inserting a full color image onto a sheet on which a text image will also appear elsewhere, of printing those two images on a single sheet by separate operations.

The foregoing is provided in the present invention, which uses either a single or double energy source (for purposes of different resolutions or printing technologies, etc.), that will also accommodate direct energy printing and/or two or more ribbons as well as a single ribbon; e.g., one for full color printing and one for black printing; one for thermal printing and the other for dye diffusion printing; or one for precoat printing and the other for full color printing over the precoat when printing on rough paper is required; and other examples are given below.. Such a energy source should also be capable of encountering a selected ribbon, as by rotation or a similar simple motion from one to the other under motor control, without need for manual entry to the printer and manipulation of the energy source.

That is, in general the printer is made to accept one or more pairs of ribbons and substrates for which appropriate energy sources are also provided, the operating parameters are set (preferably automatically) for each selected combination, and the particular energy sources, ribbons and substrates are activated as required, so as to provide optimum printing capability for each printing task.

TERMINOLOGY

The invention in its several aspects encompasses a wide range of applications, for which the use of particular terminology seems appropriate. When used hereinafter, therefore, unless otherwise indicated the following terms will have the meanings stated:

Energy Source: A source of a form of energy (heat or light), including a laser, a conventional thermal transfer print head, and the like.

Transfer material: A substance placed on a medium for the purpose of being transferred therefrom to a substrate by the application thereto of one or more forms of energy in order to form an image on the substrate, either directly or indirectly.

Printer: An apparatus that uses an energy source to apply one or more forms of energy either to a transfer material or to a substrate so as to form an image on the substrate, including a printer, a facsimile machine (FAX), the printing portion of a copier, or the printing portion of any other device that functions as stated.

Direct Energy: A method of forming an image in which one or more forms of energy are applied directly to a substrate on which the image is to be formed. The energy elicits some change in the material of the substrate so as to form the image either from that energy alone, or following passage of the substrate through a hot roll process or the like.

Technology: A particular method of transferring an image from a medium to a substrate using one or more forms of energy, including those in which the transfer material comprises thermal transfer ink, dye diffusion dye, electroresistive ink, combinations of chromogenic materials and encapsulated radiation curable compositions, combinations of a developer and a photosensitive microencapsulated material, materials subject to transfer when acted upon by light (including laser light), and materials in which both light and heat bring about changes in at least one of the group of physical parameters of said materials consisting of softening, melting and glass transition temperatures, and of viscosity. The term also encompasses developing an image by direct energy processes, as well as other methods and materials whether or not presently known or conceived.

Type: Variations in method within a particular technology, such as the use of different thermal transfer materials that require different temperatures or the like for transfer to occur.

Class: A subset of transfer materials within a particular technology, e.g., precoat, overcoat and colored ink comprise three classes of thermal transfer materials.

Panel: A single continuous region on a substrate that has had a single class of transfer material, and in a single color (where applicable), applied thereon.

Set: A collection of one or more panels that are contiguous (or nearly so) and fall within a particular class, e.g., a set of yellow, magenta and cyan (y, m, c) color thermal transfer panels.

Group: A collection of panels, or sets of panels, that fall within a single technology, e.g., a set of y, m, c panels, a black panel, and one or more panels of precoat or overcoat that all transfer by means of a single type of thermal transfer.

Medium direction: A direction extending from an energy source that points towards a particular transfer medium.

SUMMARY OF THE INVENTION

In a first aspect, the invention comprises an apparatus for thermal transfer or dye diffusion printing or the like in black, color, precoat, overcoat, etc., or any combination thereof, which includes either (1) two or more ribbons or (2) one or more ribbons and one or more direct energy processes, and permits selection between those ribbons and processes for printing. A single energy source and energy source driver are disposed within an apparatus that on one side thereof carries, e.g., one ribbon, a platen, and means for passing a substrate over that platen beneath the ribbon so as to receive an image, and a similar structure on at least one other side thereof. The single energy source and driver are rotatably mounted so as to face in alternative directions for use with one or the other of the ribbons or direct energy processes.

A second embodiment employs two or more such energy source-driver combinations, and juxtaposition of one or the other selected energy source to a selected ribbon or direct energy process is accomplished by rotation followed by energizing the appropriate driver.

In a third embodiment, an energy source assembly has two or more arrays of energy elements (e.g., thermal elements or microlasers) that face in different directions, and application of those elements to one or the other ribbon or direct energy process is accomplished by translation (and/or selective activation) of the energy source in the case that there are two arrays of elements, or by a combination of rotation and translation (and/or selective activation) if there are more than two such arrays, so as to direct the same against a selected one of the two or more ribbons. If desired, rotation and translation (and/or selective activation) can also be combined in the case of having just two arrays, if the two arrays differ in a significant respect such as element resolution or array length (printing width). (By "selective activation" is meant that in the case, e.g., of a thermal print head with opposing arrays of thermal elements, the selected array is advanced to the selected ribbon and print data are sent only to that array, while in the case of a laser array, no such movement of the array may be necessary, and only the transmittal of print data to the desired laser array will be required.)

In each embodiment, the print data to be used with a selected energy source are electronically separated in the same manner that, e.g., color print data signals (e.g., yellow, magenta and cyan signal data) are commonly separated. However, in one aspect entirely separate data (i.e., separate images) are used, e.g., black and full color images for inserting one image onto the sheet of another, or for precoat in one image, to permit using two different ribbons. Alternate mechanisms for transporting the substrate to one or more selected energy sources, and of ensuring proper registration of that substrate, are also described.

A particular advantage of the invention is the ability, through automatic print task selection, to carry out both full color and black printing on a single substrate (1) at a single position when using a combined ribbon and either one or two energy sources, and (2) at two positions when using a color ribbon and a black ribbon with either one or two energy sources.

BRIEF DESCRIPTION OF THE DRAWINGS

The preferred embodiments of the invention will now be described in detail with reference to the accompanying drawings, in which.

DETAILED DESCRIPTION OF THE INVENTION

Figure 1:
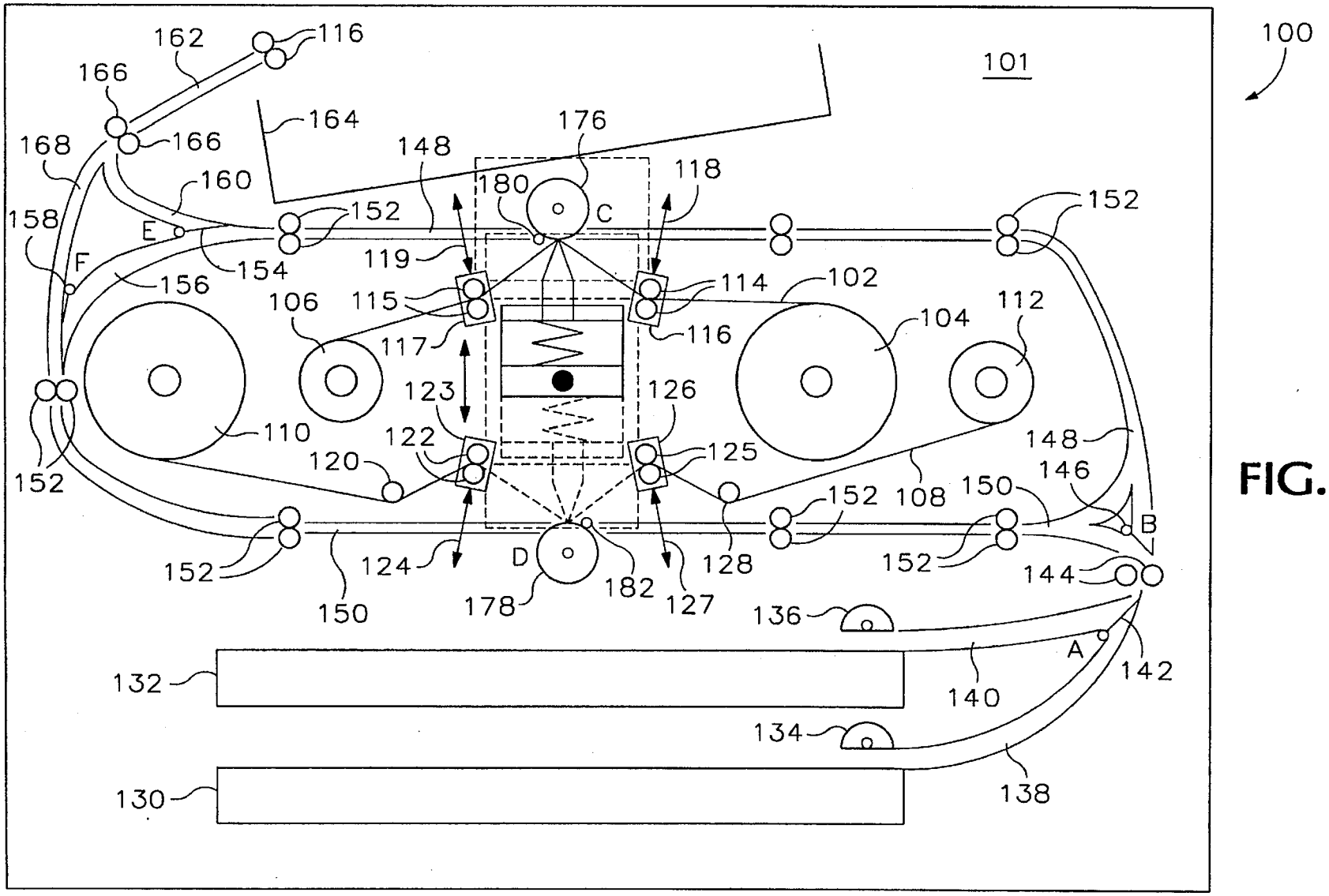
FIG. 1 shows in a side elevation schematic drawing a single-array print head-driver assembly rotatably mounted between two ribbon-platen combinations.

The first embodiment of this multi-position printer will now be described in terms of a two-ribbon model, although one of the ribbons would be deleted if a direct energy process was used at one position. It is also possible to employ an embodiment of the invention including just one ribbon when only limited capability is needed. In FIG. 1, printer 100 having a frame 101 (of which only the "back" half thereof is shown schematically in FIG. 1) includes a first ribbon 102 that may include on one side thereof, e.g., a repeating series of yellow, magenta and cyan color panels of heat sensitive ink or dye, each of such panels having a length nearly equal to that of the sub-strate to which an image is to be transferred. First ribbon 102 is unwound from a first supply roll 104 rotatably mounted on frame 101, and after use as will be discussed below, first ribbon 102 is wound onto first takeup roll 106, also rotatably mounted on frame 101. Both of first supply roll 104 and first takeup roll 106 are provided with reversible stepping motors (not shown) whereby either of rolls 104, 106 can be energized to rotate and draw ribbon from the other, and both of rolls 104, 106 are provided with slip clutches (also not shown) in the usual manner so that ribbon can be drawn from one to the other under tension. The side of ribbon 102 that bears the aforesaid panels faces outwardly from first supply roll 104 and first takeup roll 106.

Which Printer 100 further comprises a second ribbon 108, which may, e.g., be a multiprint black ink ribbon for printing on plain paper. Second ribbon 108 is unwound from a second supply roll 110 which is rotatably mounted on frame 101, and after use second ribbon 108 is wound onto second takeup roll 112, also rotatably mounted on frame 101. Second supply roll 110 and second takeup roll 112 are likewise provided with stepping motors and slip clutches (not shown), and similarly the side of second ribbon 108 that bears the panels faces outwardly from second supply roll 110 and second takeup roll 112.

The path of first ribbon 102 is controlled in part by first and second roller pairs 114, 115 each comprising two similar cylindrical rollers somewhat longer than the width of ribbon 102, and oriented with the axes thereof parallel to the width dimension of first ribbon 102 and transverse to the long dimension of first ribbon 102, in a mutually facing disposition such that first ribbon 102 passes therebetween. First and second roller pairs 114, 115 are slidably and rotatably mounted respectively on first and second slides 116, 117 shown schematically in FIG. 1, which in turn are mounted on frame 101 such that the positions thereof can be moved in a direction parallel to the plane of FIG. 1 and generally transverse to the long dimension of first ribbon 102 as shown respectively by arrows 118, 119 in FIG. 1. First and second slides 116, 117 permit first ribbon 102, as held by first and second roller pairs 114, 115, to be moved outwardly and inwardly within printer 100 for purposes that will be noted below.

First roller pair 114 and first slide 116 are located a predetermined distance from first supply roll 104, and second roller pair 115 and second slide 117 are located a predetermined distance from first takeup roll 106. First ribbon 102, first supply roll 104, first takeup roll 106, first and second roller pairs 114, 115 and first and second slides 116, 117 are mounted generally within the central part of the interior of printer 100, and in the perspective of FIG. 1, first ribbon 102 extends from and leads to the tops of first supply roll 104 and first takeup roll 106, respectively.

Second supply roll 110 is mounted onto the same end of frame 101 as first takeup roll 106 is mounted, but outwardly therefrom, and similarly second takeup roll 112 is mounted on the same end of frame 101 as is first supply roll 104, again outwardly therefrom, where the term "outwardly" means that first supply roll 104 and first takeup roll 106 lie between second supply roll 110 near one end of printer 100 and second takeup roll 112 near the opposite end of printer 100. In the perspective of FIG. 1, second ribbon 108 extends from the bottom of second supply roll 110, rightwardly across the interior of printer 100 below first takeup roll 106 and first supply roll 104, and then to the bottom of second takeup roll 112.

In extending rightwardly from second supply roll 110, second ribbon 108 touches and passes below first ribbon guide roller 120, which is a single cylindrical roller rotatably mounted to frame 101 below and inwardly within printer 100 from second supply roll 110. First ribbon guide 120 serves to separate second ribbon 108 away from first takeup roll 106. After having passed first ribbon guide roller 120, second ribbon 108 passes through third roller pair 122 which, like first and second roller pairs 114, 115, comprises two similar cylindrical rollers somewhat longer than the width of second ribbon 108, being oriented with the axes thereof parallel to the width dimension and transverse to the long dimension of second ribbon 108, in a mutually facing disposition such that second ribbon 108 passes therebetween. Third roller pair 122 is slidably and rotatably mounted on third slide 123, which in turn is mounted to frame 101 such that the position of third roller pair 122 can be moved within printer 100 in a direction parallel to the plane of FIG. 1 and generally transverse to the long dimension of second ribbon 108 as shown by arrow 124. Second ribbon 108 then passes through fourth roller pair 125 mounted to fourth slide 126 in the same manner as third roller pair 122 and third slide 123, to permit second ribbon 108, as held by third roller pair 122, to be moved within printer 100 as shown by arrow 127. Second ribbon 108 then passes under second ribbon guide roller 128, which is a single cylindrical roller rotatably mounted to frame 101 below and inwardly within printer 100 from first supply roll 104. Second ribbon guide 128 serves to separate second ribbon 108 away from first supply roll 104.

First printer 100 further comprises first and second substrate trays 130, 132 shown near the bottom of FIG. 1 that are designed to accommodate different types of substrate, e.g., plain paper and special paper for dye diffusion, letter and legal sized paper, a substrate for direct energy printing, or a transparent substrate. On some of these substrates, printing quality is better on only one surface thereof, and care must be taken to install the substrate in the tray and transport the same for printing so that the desired side will be printed upon by the ribbon (or by direct energy).

Above the respective right-hand ends of first and second substrate trays 130, 132 are first and second drive rollers 134, 136, that are rotatably mounted to frame 101 and when empowered by respective motors (not shown) serve to remove consecutive sheets of substrate from first and second substrate trays 130, 132, respectively. Extending outwardly from first and second substrate trays 130, 132, respectively, are first and second guides 138, 140, which are fixedly mounted to frame 101 and provide paths of travel for sheets of substrate that are respectively drawn out of first and second substrate trays 130, 132 by first and second drive rollers 134, 136.

First and second guides 138, 140 come close together near point A in FIG. 1, where first gate 142 is rotatably mounted to frame 101 in such manner as to control the passage of a substrate sheet from first and second guides 138, 140. Thus, when first gate 142 is in the downward position shown in FIG. 1, passage of a sheet of substrate from first substrate tray 130 and outwardly through first guide 138 is blocked, hence substrate is provided from second substrate tray 132 through second guide 140 by means of energizing second drive roller 136. Alternatively, when first gate 142 is in an upward position (not shown), passage of a sheet of substrate from second substrate tray 132 through second guide 140 is blocked, hence substrate is provided from first substrate tray 130 through first guide 138 by energizing first drive roller 134. First gate 142 and first and second drive rollers 134, 136 are preferably connected electrically so as to act cooperatively as just described, under control of a single "substrate selection switch" (not shown) employed either manually by the operator of printer 100 or automatically from the operator having selected a printing task (e.g., by icon selection on a printer monitor). It is also possible to eliminate first gate 142 and to accomplish substrate selection (again either manually or automatically) simply by selectively energizing first and second drive rollers 134, 136.

A sheet of substrate as selected from one or the other of first and second substrate trays 130, 132 enters first roller pair 144 which comprises two cylindrical rollers rotatably mounted to frame 101 with the axes thereof oriented parallel to the width of the substrate sheet and transverse to the long dimension thereof, in a mutually facing disposition such that the sheet passes therebetween. First roller pair 144 is driven by a motor (not shown) that preferably is operated in cooperation with first and second drive rollers 134, 136, and in addition provides an amount of frictional contact with a sheet of substrate passing therethrough that is sufficient to withdraw such a substrate sheet out of first gate 142.

After passing through first roller pair 144, a sheet of substrate passes into second gate 146 which is rotatably mounted to frame 101 near point B in FIG. 1 in such a manner as to divert the passage of a substrate sheet that comes from first roller pair 144 into one or the other of third and fourth guides 148, 150. Thus, with second gate 146 oriented in the upward position shown in FIG. 1, such a sheet of substrate is constrained to enter a proximal end of fourth guide 150 which extends leftwardly in a lower part of printer 100, whereas if second gate 146 is oriented in a downward position (not shown), such a sheet of substrate enters a proximal end of third guide 148 which extends upwards and then leftwardly in the upper part of printer 100. Third and fourth guides 148, 150, as extended further through printer 100, are fixedly mounted to frame 101 so as to come into proximity with the outwardly facing panel sides of first and second ribbons 102, 108 near respective points C, D in FIG. 1, and thus to bring a sheet of substrate into contiguity with one or the other of first and second ribbons 102, 108, depending upon the position of second gate 146.

Distributed along the length of third and fourth guides 148, 150 are a number of guide roller pairs 152, shown schematically in FIG. 1, which each comprise a pair of cylindrical rollers rotatably mounted to frame 101 so that a sheet of substrate passes therebetween and is urged forward through the length of either third guide 148 or fourth guide 150. As required, any of guide roller pairs 152, in the manner of first roller pair 144, can be motor driven and provide sufficient frictional contact with a sheet of substrate passing therethrough to urge that substrate sheet forward. Those of guide roller pairs 152 that incorporate motors, and particularly those in the immediate proximity of points C or D, are operated independently of the motors that serve to advance one or the other of first and second ribbons 102, 108, so that when desired a sheet of substrate can be advanced past either point C or point D without printing thereon, and specifically without expending any of first and second ribbons 102, 108, in a manner that will be described hereinafter. After passing near either point C or point D, a sheet of substrate continues on through either third or fourth guide 148, 150, respectively.

A sheet of substrate that has passed through third guide 148 past point C soon encounters third gate 154, which is rotatably mounted to frame 101 near point E of FIG. 1 and acts in the manner of first and second gates 142, 146 to direct the subsequent path of the sheet. With third gate 154 in the upward position shown in FIG. 1, a sheet of substrate is diverted into fifth guide 156 which is fixedly mounted to frame 101 and thence past fourth gate 158, which is rotatably mounted to frame 101 near point F of FIG. 1, where fifth guide 156 connects to the distal end of fourth guide 150. In other words, if third gate 154 is in the upward position shown in FIG. 1, a sheet of substrate that has passed through third guide 148 enters fifth guide 156 and, passing by fourth gate 158, passes into the distal end of fourth guide 150 in a rightwardly direction opposite that of a sheet of substrate that has been diverted directly into fourth guide 150 by second gate 146. Fourth gate 158 is preferably of a weight and construction that when fourth gate 158 is not energized, the weight of a sheet arriving thereon from fifth guide 156 is sufficient to move fourth gate 158 aside and permit the passage of that sheet into fourth guide 150, or alternatively fourth gate 158 can be energized into a leftward position (not shown) for such purpose.

It should be noted that the side of a sheet of substrate that faced onto first ribbon 102 in passing point C, upon that sheet being moved into fourth guide 150 as just described, will similarly be facing towards second ribbon 108 upon reaching point D. Therefore, the printing processes that are carried out at points C and D (to be described hereinafter) will, from the substrate movements just described, be applied to just that one side of a sheet of substrate.

If on the other hand third gate 154 is in a downward position (not shown), a sheet passing through third guide 148 enters sixth guide 160 which is fixedly mounted to frame 101, and thence to a proximal end of exit guide 162 which is fixedly mounted to frame 101 near to sixth guide 160, whereupon the substrate falls into copy tray 164 located at the distal end of exit guide 162. In order to urge a sheet of substrate upwardly from sixth guide 160 into exit guide 162, either or both of sixth guide 160 and exit guide 162 are provided with at least one of exit roller pairs 166, which comprise a pair of cylindrical rollers rotatably mounted to frame 101 with the axes thereof parallel to the widths of sixth guide 160 and exit guide 162 and transverse to the long dimensions thereof, in a mutually facing disposition such that a substrate sheet traversing sixth guide 160 and exit guide 162 will pass therethrough. Exit roller pairs 166 are driven by motors (not shown) and provide sufficient frictional contact with a sheet passing therethrough to urge such a substrate sheet upward as stated.

When directing a sheet of substrate from third guide 148 and fifth guide 156 into the distal end of fourth guide 150, fourth gate 158 was seen to serve no function except passively to permit a sheet of substrate to pass thereby. The function of fourth gate 158 when energized is to direct the further passage of a sheet of substrate that has been directed by second gate 146 directly into fourth guide 150 and has then traveled leftwardly past point D. When fourth gate 158 is in a leftward position (not shown), a sheet of substrate that has passed leftwardly through fourth guide 150 will enter fifth guide 156 and then pass rightwardly through third guide 148, i.e., in the opposite direction of a sheet that has entered third guide 148 directly through second gate 146. Again, the side of such a sheet that was facing towards second ribbon 108 near point D will similarly face first ribbon 102 near point C. On the other hand, if fourth gate 158 is in a rightward position as shown in FIG. 1, a sheet that has traveled leftwardly through fourth guide 150 will become directed upwardly into seventh guide 168 which is fixedly attached to frame 101 and thence through exit guide 162 and one or more roller pairs 166 to exit at copy tray 164.

When a sheet of substrate is passed leftwardly through third guide 148 at a time that third gate 154 at point E is set upward so as to direct that sheet downwardly to arrive within fourth guide 150, or conversely when such a sheet is passed leftwardly through fourth guide 150 at a time that fourth gate 158 at point F is positioned leftward so as to direct that sheet rightwardly past third gate 154 to arrive within third guide 148, one side of the sheet will have been exposed to both of first and second ribbons 102, 108 so as to permit printing from both such ribbons onto that facing side of the sheet. Preferably, the abovementioned motors (not shown) that drive one or more of guide roller pairs 152 are reversible so that a sheet of substrate can be moved either rightwardly or leftwardly within both of third and fourth guides 148, 150, e.g., a sheet of substrate that has passed through third gate 154 rightwardly and is so passing through third guide 148 can be moved past point C and then reversed in direction as though it had originally entered third guide 148 moving leftwardly.

The foregoing discussion with regard to the direction of movement of a sheet of substrate is significant with respect to the manner in which the printing is carried out. As will be discussed hereinafter, the printing assemblies of the current art are designed to conduct the printing process with the substrate moving therethrough in just one direction, not both. For purposes of illustration, therefore, printer 100 as depicted in FIG. 1 has been structured so that printing ordinarily occurs with the substrate moving leftwardly past point C and rightwardly past point D. That can perhaps be seen most easily from the stated designations of the supply and takeup rolls: in such printing, the ribbon is made to move in the same direction as the substrate, hence first supply roll 104 is located to the right of first takeup roll 106, and first ribbon 102 passes leftwardly therebetween past point C, and similarly second supply roll 110 is located to the left of second takeup roll 112, and second ribbon 108 passes rightwardly therebetween past point D.

(Therefore, to optimize the printing capabilities of printer 100 and accommodate, e.g., both precoat and full color printing as will be described hereinafter, first ribbon 102 would comprise such a precoat transfer material, and a sheet of rough substrate having been so precoated near point C and thus given a smooth surface would then be conveyed around to point D to receive the desired full color printing. Similarly, first ribbon 102 can be a yellow, magenta and cyan color ribbon (e.g., when using smooth paper), and second ribbon 108 can be of a black transfer material for adding text to the full color image produced near point C.)

It must also be noted that while a sheet of substrate having been passed into either of third and fourth guides 148, 150 and then onwardly to the other of third and fourth guides 148, 150 will be printed upon on just one side thereof, which side of the substrate that turns out to be depends upon which of third and fourth guides 148, 150 that sheet first enters. Thus, if a sheet of substrate is taken from either of first and second substrate trays 130, 132 and passed firstly into third guide 148 as just stated, the side of such a sheet that was facing upwardly within either of first and second substrate trays 130, 132 becomes the side printed upon near both of points C and D. A sheet that is passed from either of first and second substrate trays 130, 132 directly into fourth guide 150, on the other hand, will be printed upon on the side thereof that had been facing downwardly. From what was said earlier, therefore, it is clear that when using a substrate that is adapted to receive printing on but one side—e.g., a substrate that has already been precoated on one side, or has been conditioned to receive direct energy printing on just one side—that substrate must ordinarily be placed into either of first and second substrate trays 130, 132 with the side so adapted to receive printing facing upward.

Figure 1A:
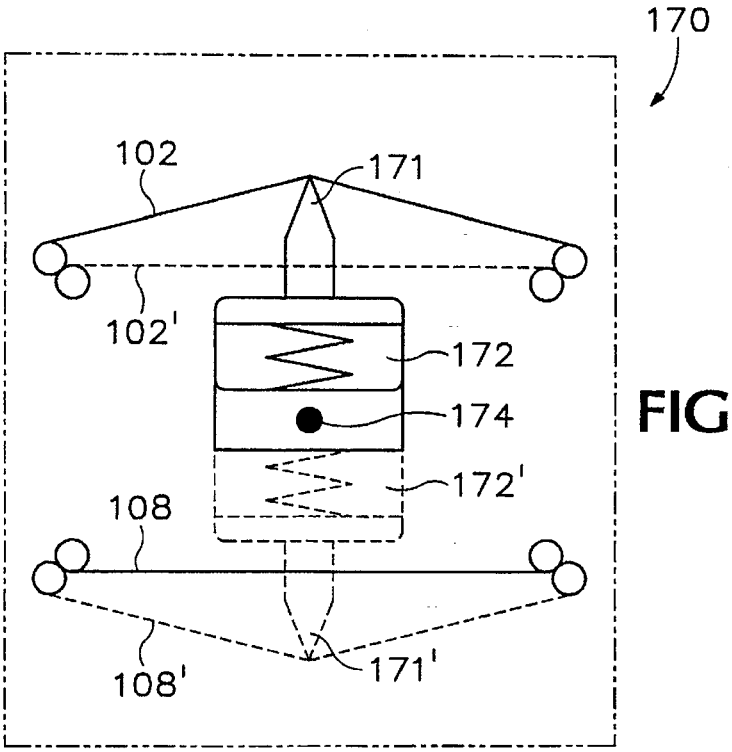
FIG. 1A illustrates the rotatably mounted printhead and driver motor of FIG. 1.

For illustration, printer 100 will now be further described in terms of a thermal printing process, although the specific technology to be employed is not so limited and may include any of the options defined previously under the term "Technology." As also shown in FIG. 1, printer 100 further comprises a print head assembly 170 (the position of which is shown in FIG. 1 but for clarity the components of print head assembly 170 have been duplicated for description in FIG. 1A). Print head assembly 170 comprises a print head 171 mounted to a spring-loaded driver motor 172 in the usual fashion so as to cause forward or backward motion of print head 171 as desired. Driver motor 172 is rotatably mounted to frame 101 at a central location within printer 100 between first and second ribbons 102, 108 by means of shaft 174 which is operated by a motor (not shown) under either operator or automatic control.

Through such rotations, print head 171 and driver motor 172 can be positioned as shown by solid lines in FIG. 1, or by rotation thereof by 180 degrees about the axis of shaft 174, in the alternative positions of print head 171' and motor 172' shown in phantom in FIG. 1 (and 1A). In these two positions, print head 171 (or 171') will be placed, respectively, in contiguity with either first ribbon 102 near point C or second ribbon 108 near point D. Preferably, the direction of rotation of print head 171 will be automatically alternated through successive rotations, so that the necessary twisting of various cable connections (not shown) to print head 171 will not lead ultimately to binding. By then energizing driver motor 172 (172'), print head 171 (171') is moved outwardly within printer 100 so as to contact either first ribbon 102 or second ribbon 108, respectively, in the usual manner. In so doing, either print head 171 and first ribbon 102 will be pressed against a sheet of substrate passing through third guide 148 and against first platen 176 near point C, or print head 171' (which, again, represents print head 171 rotated by 180 degrees) and second ribbon 108 will be pressed against a sheet of substrate passing through fourth guide 150 and second platen 178 near point D, both of platens 176, 178 being rotatably mounted to frame 101 to aid in printing in the usual manner.

Also in the usual manner, first and second pinch rolls 180, 182 shown in FIG. 1 serve respectively to hold a sheet of substrate against first and second platens 176, 178 during the printing process. The function of first and second pinch rolls 180, 182 is significant with regard to the full color printing previously mentioned, in that (1) the substrate is moved leftwardly towards first platen 176 and first pinch roll 180 (or rightwardly towards second platen 178 and second pinch roll 182) so as to be grasped thereby; (2) a first color (e.g., yellow) is printed to the desired length by rotation of the platen and pinch roll in cooperation with movement of the ribbon and the transmission of print data to the print head; (2) the platen and pinch roll are rotated back to their original positions while the ribbon is moved to provide access to the next desired color panel (e.g., magenta); and then (3) the second printing is conducted without the substrate having been released from the platen and pinch roll (and so forth for a third or more printings), so that registration between the successive color images can be maintained. With regard to what was said about the printing process ordinarily being carried out with the substrate moving in but one direction, it may be noted that first and second pinch rolls 180, 182 are disposed respectively to the left and the right of first and second platens 176, 178, i.e., in a position that will place the top of a sheet of substrate at an appropriate position relative to print head 171 (or 171') for printing to occur.

Thus, a sheet of substrate that is passed rightwardly past point C (or leftwardly past point D) cannot be printed upon as just stated. Of course, such a sheet can be passed rightwardly all the way past point C and then be reversed to be grasped for printing, and similarly a sheet can first be passed leftwardly past point D and then be reversed for printing. One purpose in so doing can be to print on a different side of the substrate since, as was noted earlier, which side of a sheet becomes printed upon depends upon which of third and fourth guides 148, 150 the sheet is first made to enter. (By appropriate control of the motors of guide roller pairs 152 and exit roller pairs 166, a sheet can be transported past point C into exit guide 162 and then back down past point F into fourth guide 150 to point D with a different side of the sheet facing towards printer assembly 170 than had been so facing in passing point C.)

Returning now to the printing process, in conducting such printing it is common for a ribbon such as first or second ribbons 102, 108 to contact the sheet upon which an image is to be transferred at an angle. As can be seen in FIG. 1, first and second roller pairs 114, 115 are located at such points that as first ribbon 102 extends between first and second roller pairs 114, 115, in moving print head 171 forward (i.e., outwardly) by driver motor 172, the portion of first ribbon 102 that lies between first and second roller pairs 114, 115 and shown by the solid line is forced into such an angle. Given that print head 171 and driver motor 172 are in the positions as shown in FIG. 1 (and 1A) by solid lines, however, the portion of second ribbon 108 that lies between third and fourth roller pairs 122, 123 in the lower part of printer 100 extends directly therebetween, as is also shown by a solid line.

On the other hand, upon a 180 degree rotation of print head 171 and driver motor 172 to yield the configuration of print head 171' and driver motor 172' shown in phantom in FIG. 1 (and 1A), first ribbon 102' passes directly between first and second roller pairs 114, 115, and second ribbon 108' assumes an angled conformation as made necessary by the indicated positions of third and fourth roller pairs 122, 123. Both such ribbon positions are also shown in phantom in FIG. 1 (and 1A).

The role of first, . . . , fourth roller pairs 114, 115 and 122, 123 in achieving the desired annular relationship between print head 171 (171') and either first ribbon 102 and first platen 176 or second ribbon 108 and second platen 178 requires placing first, . . . , fourth roller pairs 114, 115 and 122, 123 as indicated in FIG. 1; however, when first, . . . , fourth roller pairs 114, 115, 122, 123 are in those positions, there is interference with the ability to rotate print head 171 and driver motor 172 as described above so as to select either of first or second ribbons 102, 108 for use. It is thus the purpose of first, . . . , fourth slides 116, 117, 124, 125 to permit outward movement of first, . . . , fourth roller pairs 114, 115, 122, 123 so as to provide sufficient clearance within the central portion of printer 100 to permit rotation of print head 171 and driver motor 172 as described. Therefore, to switch from one configuration to another, i.e., from one ribbon to another, drive motors (not shown) on first, . . . , fourth slides 116, 117, 124, 125 are energized so as to move first, . . . , fourth roller pairs 114, 115, 122, 123 outwardly as shown by arrows 118, 119, 126 and 127, respectively, and after the desired rotation of print head 171 and driver motor 172 is accomplished, the aforesaid slides are energized in the reverse direction to return first, . . . , fourth roller pairs 114, 115, 122, 123 to the positions shown in FIG. 1. The described operation of first, . . . , fourth slides 116, 117, 124, 125 is made to occur as part of either an operator-controlled or automatic instruction to rotate print head 171.

Figure 2:
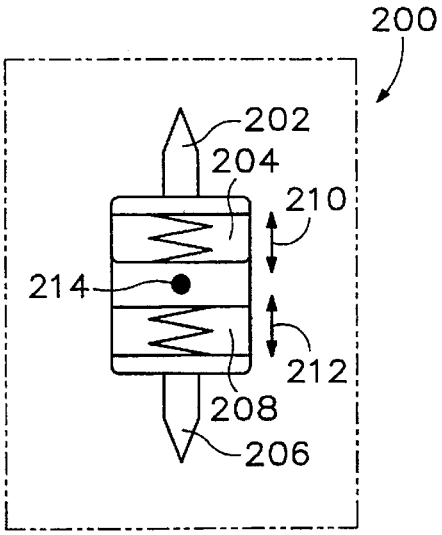
FIG. 2 shows in a side elevation schematic a rotatably mounted print head assembly having two single-array print heads and drivers.

The second embodiment of the invention is constructed in the same manner as the first embodiment shown in FIG. 1 except that a different print head assembly is used. That is, FIG. 2 shows an alternative print head assembly 200 that is placed into the structure of FIG. 1 in lieu of print head assembly 170. Print head assembly 200 is rotatably mounted to frame 101 of FIG. 1 within the central region of printer 100 (i.e., within the region occupied by print head assembly 170 in FIG. 1) and comprises a first print head 202 attached to first print head driver 204, and second print head 206 attached to second print head driver 208, such that first and second print head drivers 204, 208 respectively serve to move first and second print heads 202, 206 outwardly and inwardly within printer 100 as shown by arrows 210, 212 so as to come into or move away from contact with first or second ribbons 102, 108.

In this second embodiment, by also mounting print head assembly 200 to frame 101 in a rotatable fashion by means of shaft 214 (which is energized by a motor as before to achieve a 180 degree rotation, in conjunction with the described operation of first, . . . , fourth slides 116, 117, 124, 125), selection is made possible not only as to which of first and second ribbons 102, 108 are to be used for a particular printing task, but at the same time which of first and second print heads 202, 206 are to be used with either such ribbon. It thus becomes possible to select a print head or energy source most appropriate to a particular task, e.g., to select a laser source, a high resolution energy source for precision color printing and a lower resolution energy source for printing black text, or energy sources of different power levels, print heads of different lengths, and the like. In this and each of the other embodiments of the present invention, it is preferable that printer 100 incorporate the ribbon identification methods and apparatus as described in co-pending Appl. Ser. No. 08/039,871 filed Mar. 30, 1993, so that (1) the range of possible printing methods as determined by the nature of the particular ribbons that at the moment are installed (or not) will be known; and (2) either by direct operator control or automatically through printing task selection the optimum energy/ribbon (or no ribbon, in the case of direct energy printing) combination will be realized.

For the types of document often required that provide mainly text but with a color print inserted into one small area, a high resolution print head for color may be of a smaller size, e.g., 4 inches, while the print head for text may be 8 inches. Since in this case the color image need extend only part way down the substrate, the amount of yellow, magenta and cyan (y, m, c) color ribbon required for each sheet will be less. A narrower y, m, c color ribbon having panels of that smaller longitudinal dimension can be used, or each panel set of a y, m, c color ribbon having larger panels can be used for two or more images.

Figure 3:
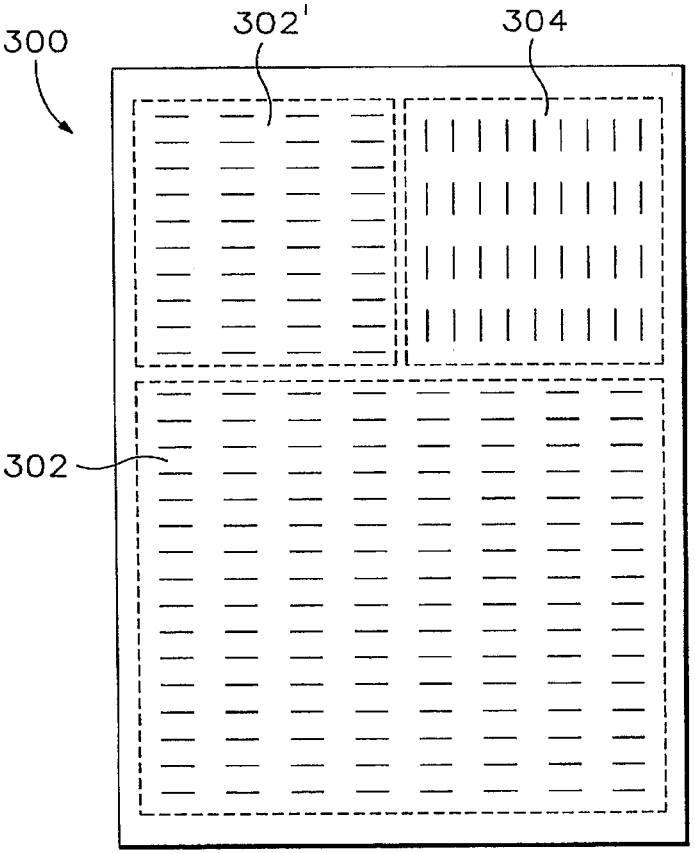
FIG. 3 shows a plan view of a document including text printed in black and a smaller full color image.

A document 300 of the type just described is shown in FIG. 3, in which a first image region 302 comprises text as indicated by the horizontal dashed line, and a smaller second image region 304 in one corner of document 300 and indicated by vertical dashed lines comprises a full color image (e.g., a company logo, or photograph of a person or the like). (The size of second image region 304 relative to that of first image region 302, i.e., approximately one-half of the horizontal dimension of document 300 and one-third of the vertical dimension thereof, is of course only one possible example.) In the upper portion of document 300, first image region 302 extends only part way across document 300, i.e., through the subregion of first image region 302 that is labelled 302' and separated by ghost lines. The text of subregion 302' extends approximately one-half the width and one-third the length of document 300, thereby providing space for second image region 304, while in the lower two-thirds of region 302 the text extends the full width thereof.

Of course, the foregoing description must be regarded as being illustrative only, in that it is not necessary that first and second image regions 302, 304 must be separated: when precise registration is not required and using an appropriately colored panel ribbon as second ribbon 108, for example, second region 304 may be for the purpose of providing highlighting at point D to black text that was printed at point C.

One manner of accomplishing the printing of a document such as document 300 according to the invention is shown in FIG. 4. The text of document 300 can be printed by either one of first and second print heads 202, 206 and one of first and second ribbons 102, 108, wherein the selected print head is as usual of a length (e.g., 8 inches) to extend fully across document 300, and the ribbon is, e.g., a continuous black ink panel. The full color image to be placed in second image region 304 is then printed by the other of first and second print heads 202, 206 (having a length, e.g., of 4 inches) and the other of first and second ribbons 102, 108.

Figure 4B:
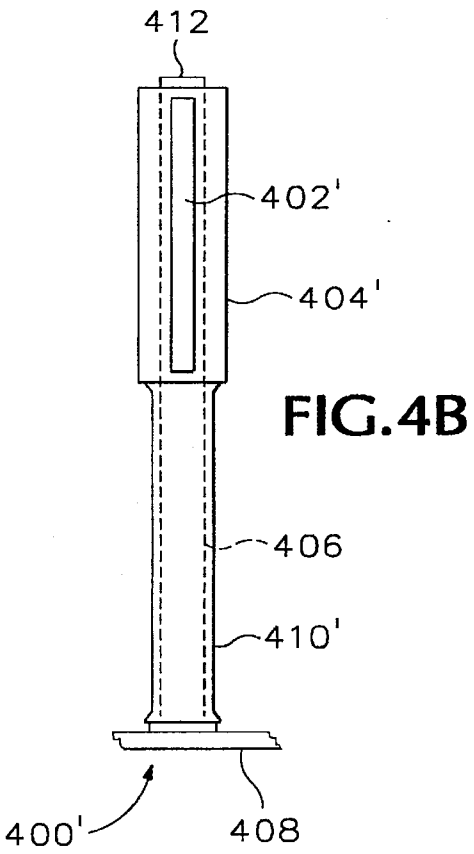
FIG. 4A and 4B show alternative mountings of a relatively shorter print head for printing the smaller full color image of FIG. 3.
Figure 4A:
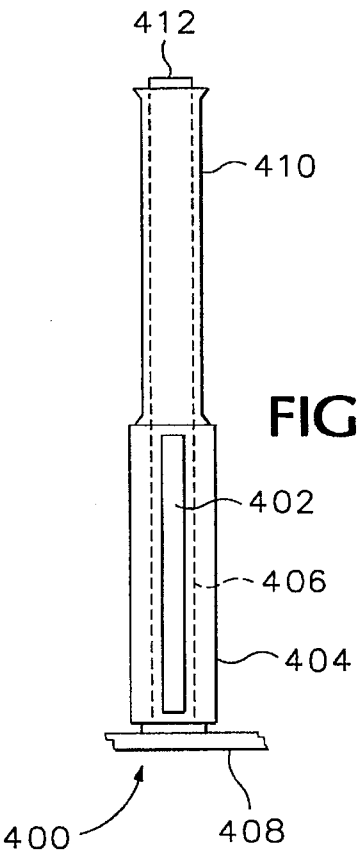

Such a print head is shown in printing assembly 400 of FIG. 4A as print head 402. Print head 402 is depicted in FIG. 4A as extending upwardly (out of the paper) from print head driver 404, which is slidably mounted onto shaft 406 (shown by dashed lines) that in turn is rotatably mounted to frame 408. (For simplicity, the rotation mechanism for shaft 406, which can be a simple motor, is not shown.) Also slidably mounted onto shaft 406 is sleeve 410, which has been placed onto shaft 406 after the placement thereon of print head driver 404 (and print head 402). Cap 412, which may be a wing nut or the like, screws onto shaft 406 at the end thereof opposite frame 408, thereby holding print head driver 404 and sleeve 410 in place. By visualizing rotating document 300 in FIG. 3 by 90 degrees and passing the same top first beneath the structure of FIG. 4A, and also rotating shaft 406 by 180 degrees so that print head 402 points downwardly into the plane of FIG. 4A, it can be seen that print head 402 is in an axial position on shaft 406 to carry out full color printing within second image region 304 of FIG. 3.

Alternatively, sleeve 410 can be placed onto shaft 406 prior to the placement thereon of print head driver 404 (and print head 402), and such a placement is shown in printing assembly 400' of FIG. 4B (as print head 402', print head driver 404', and sleeve 410'). In this case, print head 402' is in an axial position on shaft 406 to print within the region in FIG. 3 to the left of second image region 304, i.e., in subregion 302'. Thus, by (1) selecting either of the print head placements of FIGS. 4A or 4B, and (2) controlling the transmittal of print data to the print head so as to print within, e.g., the top, middle or bottom third of document 300, the structures of FIGS. 4A, 4B permit the positioning of a region accessible to full color printing to lie within any one selected one-sixth portion of FIG. 3. In the event, e.g., that sleeve 410 had a length twice that of print head 402, or comprised two such sleeves each of the length of print head 402, so that print head 402 extended across only one-third the width of document 300 and sleeve 410 (in one or two parts) extended for two-thirds thereof, the corresponding full color image region would be correspondingly smaller but could be placed within any one-third of the width of document 300, and at as many vertically displaced positions as would be defined by the height of that image region. Of course, the length of print head 402 can be established at some other fraction of the full document width as well, or at any size equal to or less than that full width.

Referring again to FIG. 3, subregion 302' can also be printed by a full width black ribbon just as is region 302, and region 304 can be printed using a full width y, m, c ribbon. However, when using a ribbon for full color printing of a size to encompass the full width of document 300, i.e., of the same size as that used to print the text in first image region 302, to print only the smaller second image region 304 would leave one-half of the width of such a ribbon unused. In co-pending Appl. Ser. No. 08/039,871 filed Mar. 30, 1993, means are described for recording ribbon usage so that unused portions of a ribbon can be located at a later time for use. In brief, (1) each ribbon panel (and set of which the panel is a member) is identified by a marker, as are distances within each panel; (2) the markers are read by a sensor as the ribbon is transported from roll to roll so that a continuing record is kept of the position of the ribbon; (3) the corresponding periods during which printing was actually carried out are recorded by one of several alternative means; and (4) a microprocessor analyzes those events and has provision for locating unused ribbon portions. Those procedures can also be applied in the present context for recording which transverse portions of a ribbon would have been used, e.g., to print a series of images of the type of second image region 304, so that unused transverse portions of the ribbon can similarly be identified for later use. Thus, if print head 402 is used in the position shown in FIG. 4A so as to print images of the type of second image region 304, by also recording in which position print head 402 had been placed during such printing, a usage record is obtained that applies only to that portion of the ribbon that was so used, and similarly with respect to other placements of print head 402 (e.g., as shown in FIG. 4B), so that the ribbon could be used later for printing in other regions.

Alternatively, one can use ribbons of essentially the same width as the length of print head 402 shown in FIGS. 4A, 4B, or the other lengths mentioned, and similar sleeves can be used on shafts that hold the supply and takeup rolls for such ribbons so the ribbon can be placed in the same lateral position as the print head. In that case, there would be no unused transverse portions of the ribbon, hence the ribbon marking and usage procedures of co-pending Appl. Ser. No. 08/039,871 filed Mar. 30, 1993 become directly applicable.

This latter procedure is advantageous for the reason that most users of printer 100 may be little inclined to enter printer 100 manually so as to move ribbons and print heads about to various desired positions. Indeed, various users may seek the capability of providing inserted images at quite different lateral positions on a full sheet of substrate, but which for each of them will be quite fixed. The foregoing aspect of the invention allows the manufacturer to provide such print head placements as may be desired, and for economic reasons a ribbon corresponding in size and placement to that of the print head can also be provided.

As another example of ribbon applications, if one of first and second ribbons 102, 108 is formed of y, m, c color panels and the other either has black panels or is continuous black, the black ribbon can be used for text and selected ones of the y, m, c panel sets can be used for highlighting. (Here again, the ability after such usage to identify unused panels, or unused portions of panels, is particularly valuable since it eliminates any hesitance to use y, m, c panels for highlighting—it being assumed in the prior art that such unused panels or portions thereof would be wasted.) The ability to select a black ribbon from within a full color printer also provides opportunity to preview full color images quickly with less expense by sending the color print data through a color transformation matrix and then printing black versions thereof using the black ribbon.

Turning again to the embodiment of FIG. 2, it will be understood that the ability to rotate print heads 202, 206 and drivers 204, 208 to provide access of either of print heads 202, 206 to either of ribbons 102, 108 need not be incorporated, so that only the specific configuration of print heads 202, 206 and drivers 204, 208 shown in FIG. 2 would be available. That is, print head assembly 200 would be fixedly rather than rotatably mounted. The role of first, . . . , fourth slides 116, 117, 124, 125 in permitting outward movement of first, . . . , fourth roller pairs 114, 115, 122, 123 would then become superfluous and could likewise be deleted.

Figure 5:
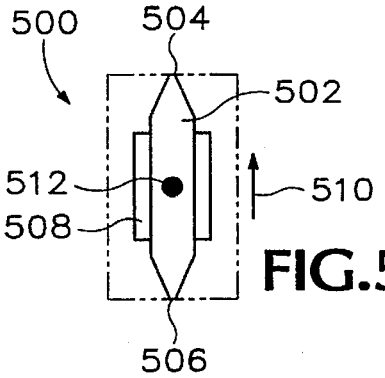
FIG. 5 shows in a side elevation schematic a movably mounted double-array print head assembly.

FIG. 5 shows in schematic form a third embodiment of the invention comprising a print head assembly 500 mounted centrally to frame 101 in lieu of either print head assembly 170 or print head assembly 200. Print head assembly 500 further comprises a print head 502 having oppositely facing first and second electrode columns 504, 506 which may have different levels of resolution. It is preferable that first and second electrode columns 504, 506 be connected to separate data lines (not shown) so that the one of first and second electrode columns 504, 506 that is not in use at a particular time will not be subjected to unnecessary thermal cycling as a result of print data being sent to the one electrode column that is in use.

Print head 502 is movably mounted to an underlying (in the perspective of FIG. 5) driver motor 508 which when energized provides movement of print head 502 in the directions of arrow 510 so that either first electrode column 504 is brought into contiguity with first ribbon 102 or second electrode column 506 is brought into contiguity with second ribbon 108. Preferably, driver motor 508 is rotatably mounted to frame 101 by shaft 512 to permit 180 degree rotation as well as linear movement of print head 502, whereby either of first or second electrode columns 504, 506 can be brought into contiguity with either of first and second ribbons 102, 106 similarly to the function of the second embodiment of the invention in FIG. 2. That is, by 180 degree rotation of print head 502 from the position shown in FIG. 5, it becomes possible by straight line movement of print head 502 to place first electrode column 504 into contiguity with second ribbon 108, or in that same rotational position to put second electrode column 506 into contiguity with first ribbon 102. The major operational difference between the second and third embodiments of the invention as shown in FIGS. 2 and 5 is that in the second embodiment of FIG. 2, first and second print heads 202, 206 can be operated simultaneously, whereas in the third embodiment of FIG. 5 only one of first or second electrode columns 504, 506 can be in operation at a time. As before, the embodiment of the invention shown in FIG. 5 can also be constructed such that driver motor 508 is fixably mounted to frame 101 so that the aforesaid rotation is not possible (and first, . . . , fourth slides 116, 117, 124, 125 again become superfluous).

Figure 6:
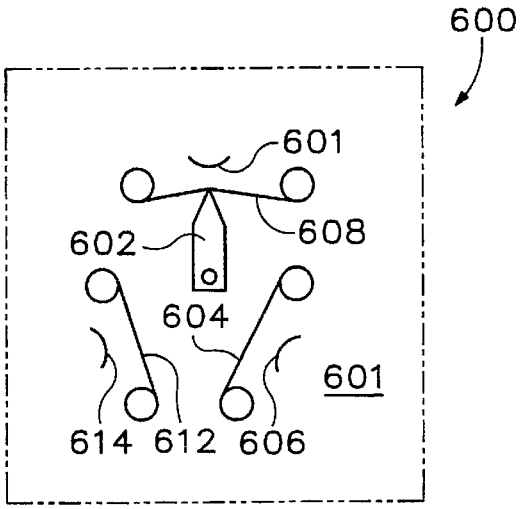
FIG. 6 shows in a side elevation schematic a portion of an embodiment of the invention similar to that of FIG. 1 but having three ribbon-platen combinations.

A portion of another printer 600 is shown in FIG. 6, onto frame 601 of which are attached three ribbon-platen assemblies. For simplicity, FIG. 6 includes but a single print head 602 and does not include the mechanism shown in FIG. 1 for transporting a sheet of substrate to a ribbon-platen interface for printing. In brief, FIG. 6 shows attached to frame 601 what will be referred to simply as a first ribbon cassette 604 (made up of a supply roll, a takeup roll and a ribbon), first platen 606, second ribbon cassette 608 (similarly made up), second platen 610, third ribbon cassette 612 and third platen 614. Each combination of first ribbon cassette 604 and first platen 606, second ribbon cassette 608 and second platen 610, and third ribbon cassette 612 and third platen 614 is disposed about print head 602 at an angle of (ideally) 120 degrees from each of the other combinations. FIG. 6 thus illustrates the case mentioned earlier that more than two ribbon structures can be incorporated within the invention. Of course, in this and any of the other embodiments, the ribbon cassette of a particular ribbon cassette-platen combination can be deleted in favor of providing direct energy printing with that particular platen. (Other embodiments not involving the use of a platen will be discussed below.)

Another distinction pertaining to FIG. 6 is this: it is common for a ribbon to be installed on a supply roll such that the side of the ribbon bearing the image-transferring ink or dye or the like faces outward, hence the ribbon rolls must be installed as shown in FIG. 1 so that the print head lies on the side of the supply and takeup rolls opposite that of the ribbon which stretches therebetween. As also shown in FIG. 1, the platen must then lie on the same side of the supply and takeup rolls as does the ribbon. In FIG. 6, however, it is print head 602 that is on the same side of the supply and takeup rolls as is the ribbon stretched therebetween, hence (1) the platen must be disposed on the side of the supply and takeup rolls opposite the ribbon; and (2) the ribbon must be disposed on those rolls with the side thereof bearing the image-transferring ink or dye or the like facing inward. It is intended to incorporate both such structures within the scope of the invention.

Figure 7A:
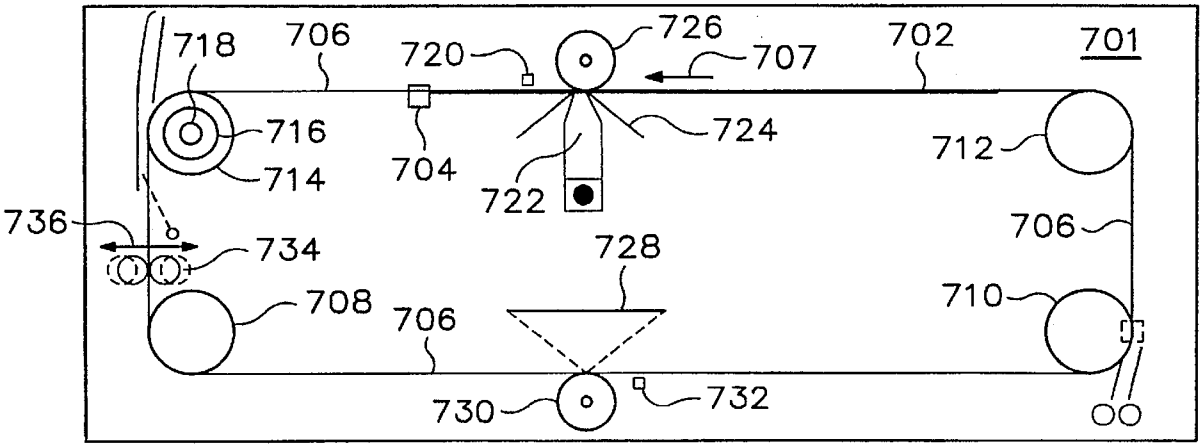
FIG. 7A shows in a side elevation schematic a portion of an embodiment of the invention similar to that of FIG. 1 except employing an alternate belt/clamp means for transporting and controlling movement of the substrate.
Figure 7B:
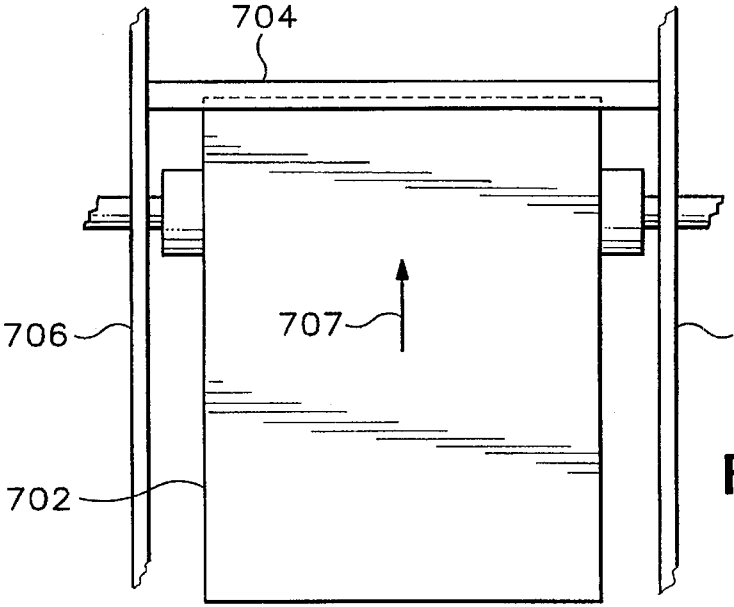
FIG. 7B shows a top plan view of a substrate sheet, and a clamp and belt apparatus for transporting the substrate.

FIG. 7A shows in side view an alternative and (for registration purposes) preferred apparatus 700 for transporting a sheet of substrate that is to receive an image. (For simplicity, in FIG. 7A the substrate trays for providing such sheets, the guides that remove printed sheets from the printer, and the receiving tray, each of which are similar to the corresponding elements as shown in FIG. 1, are deleted.) A substrate sheet 702 (after having been fed from such a supply tray) is initially grasped at one end thereof by clamp 704 which is attached in turn to continuous belt pair 706. (FIG. 7B shows a top plan view of substrate sheet 702, clamp 704 and a segment of belt pair 706, wherein substrate sheet 702 is moved in the direction of arrow 707.) Belt pair 706 is preferably toothed on the two inner circumferences thereof to help avoid slippage when used as described below.

Belt pair 706 extends around the outside of the somewhat rectangular shape defined by the locations of first wheel 708, second wheel 710, third wheel 712 and fourth wheel 714, each of which are rotatably mounted to frame 701. One of the wheels, e.g., fourth wheel 714 near the upper left-hand corner of FIG. 7A, is driven by motor 716 which also includes thereon a shaft encoder 718. It is the purpose of shaft encoder 718 to define the displacement between print lines during printing.

Upon being grasped by clamp 704, sheet 702 is moved counterclockwise around the aforesaid rectangular (more or less) path until clamp 704 comes into a position to be detected by sensor 720. The commencement of printing of an image onto sheet 702 is controlled in terms of a predetermined number of rotational pulses measured at shaft encoder 718 following the detection of the leading edge of clamp 704 by sensor 720. As shown in FIG. 7A, sheet 702 is in the course of being printed upon by the actions of print head 722, first ribbon 724, and first platen 726 in the usual manner. (Again for simplicity, the essentially identical disposition of ribbons, supply rolls and takeup rolls that was described in detail with reference to FIG. 1 is excluded from FIG. 7A.)

If a particular sheet 702 is to be printed upon more than once from the same ribbon (e.g., first ribbon 724), following the first such printing that sheet 702 can be conveyed around the aforesaid path until the leading edge of clamp 704 is again detected by sensor 720, and then the second such printing is commenced. (For example, first ribbon 724 might include separate panels in yellow, magenta and cyan, and three passes of sheet 702 past first print head 722 would be required in order to obtain full color printing.) Alternatively in terms of positioning sheet 702 for additional printing, the number of rotational pulses measured at shaft encoder 718 that correspond to a full circuit of sheet 702 around the aforesaid path can be predetermined, and a second (or third) printing would commence upon measurement of that number of such pulses.

On the other hand, if sheet 702 is instead (or additionally) to be printed upon by second ribbon 728 and second platen 730 in the lower part of FIG. 7A (as, e.g., if second ribbon comprised black ink for printing text for an inserted image), printing can commence at a predetermined number of rotational pulses following the detection of the leading edge of clamp 704 by sensor 732 (or by counting off the number of rotational pulses measured at shaft encoder 718 that corresponded to one-half of a full circuit of the path).

The aforesaid apparatus for positioning sheet 702 for printing provides advantages in ensuring accurate registration between successive images. When inserting a separate full color image such as that of second image region 304 in FIG. 3 into a document such as document 300 that also includes text (as in first image region 302 of FIG. 3) the matter of precise registration is not so important. When creating a full color image, on the other hand, accurate registration is extremely important if miscoloration is to be avoided: the print head may have a resolution of 400 dots per inch within one line of image, and such resolution cannot provide a high quality print if good registration cannot be achieved with respect to printing a dot on sheet 702 relative to other such dots already printed. For example, when printing on a single sheet with two different platens or drums or the like that each provide movement to the sheet, a difference of 0.5 percent between the circumferences of the two platens or the like becomes reflected in a like displacement of the images as defined by the line displacement signals obtained from encoders mounted on the platens, e.g., 0.05 inch displacement in a ten inch image. At 400 dots per inch resolution, that error represents an image displacement of 20 lines away from the intended location. The apparatus of FIG. 7, on the other hand, controls sheet displacement by way of a single shaft encoder so that such errors are less likely, hence print quality defects arising from misregistration are less noticeable.

To aid in achieving that kind of resolution by way of continued support of sheet 702, roller pairs 734, which are rotatably mounted to frame 701, are distributed throughout the pathway of belt pair 706. As indicated by the dashed images of roller pairs 734 and by arrow 736, roller pairs 732 are constructed so as to permit separation therebetween at any time that clamp 704 is to pass therethrough, but to close again to provide more control over the positioning of sheet 702.

In spite of the foregoing, however, to achieve the best registration between successive printings it is preferred that once a sheet of substrate has been grasped and positioned for purposes of printing thereon, the sheet should remain as so grasped until all printing processes are completed, being moved only as a part of the actual printing processes. It is also useful to employ a single y, m, c ribbon such as ribbon 724 for full color printing at a single print head, and to use ribbon 728 for, e.g., precoat or overcoat or black text. When using precoat or overcoat, the image can also be made somewhat oversized to ensure that no portion of the image-bearing substrate will remain unprotected. Other means for accomplishing registration control will be described below.

Turning back now to the general construction of printer 100, it should also be noticed that the general disposition of gates and guides within printer 100 also permits ejection of a printed sheet into copy tray 164 with the printed side either up or down. For example, a sheet that has been printed upon by print head 171 near point C in FIG. 1 will continue onward through third guide 148 to third gate 154, which if in a downward position (not shown) will pass the sheet upwardly into sixth guide 160 and ultimately into copy tray 164 with the printed side up. On the other hand, if third gate 154 is in the upward position shown in FIG. 1, the sheet will be passed downwardly into fifth guide 156, from which it can be urged further past fourth gate 158 into the distal end of fourth guide 150. If the sheet is then urged in the opposite direction, and fourth gate 158 is in the rightward position shown in FIG. 1, the sheet will pass leftwardly through fourth gate 158 into seventh guide 168 and ultimately into copy tray 164 with the printed side down. A similar procedure may of course be carried out with respect to a sheet that has been printed upon only from ribbon 108: the sheet will ordinarily be ejected into copy tray 164 with the printed side down, but if it is first urged past third gate 154 into the distal end of third guide 148 and its motion is then reversed, the sheet will pass into copy tray 164 with the printed side up. Similarly with regard to the substrate control apparatus of FIG. 7, a sheet 702 can be urged by drive rollers 734 through similar routes so as to emerge with the printed side either up or down as the user may select.

Figure 8:
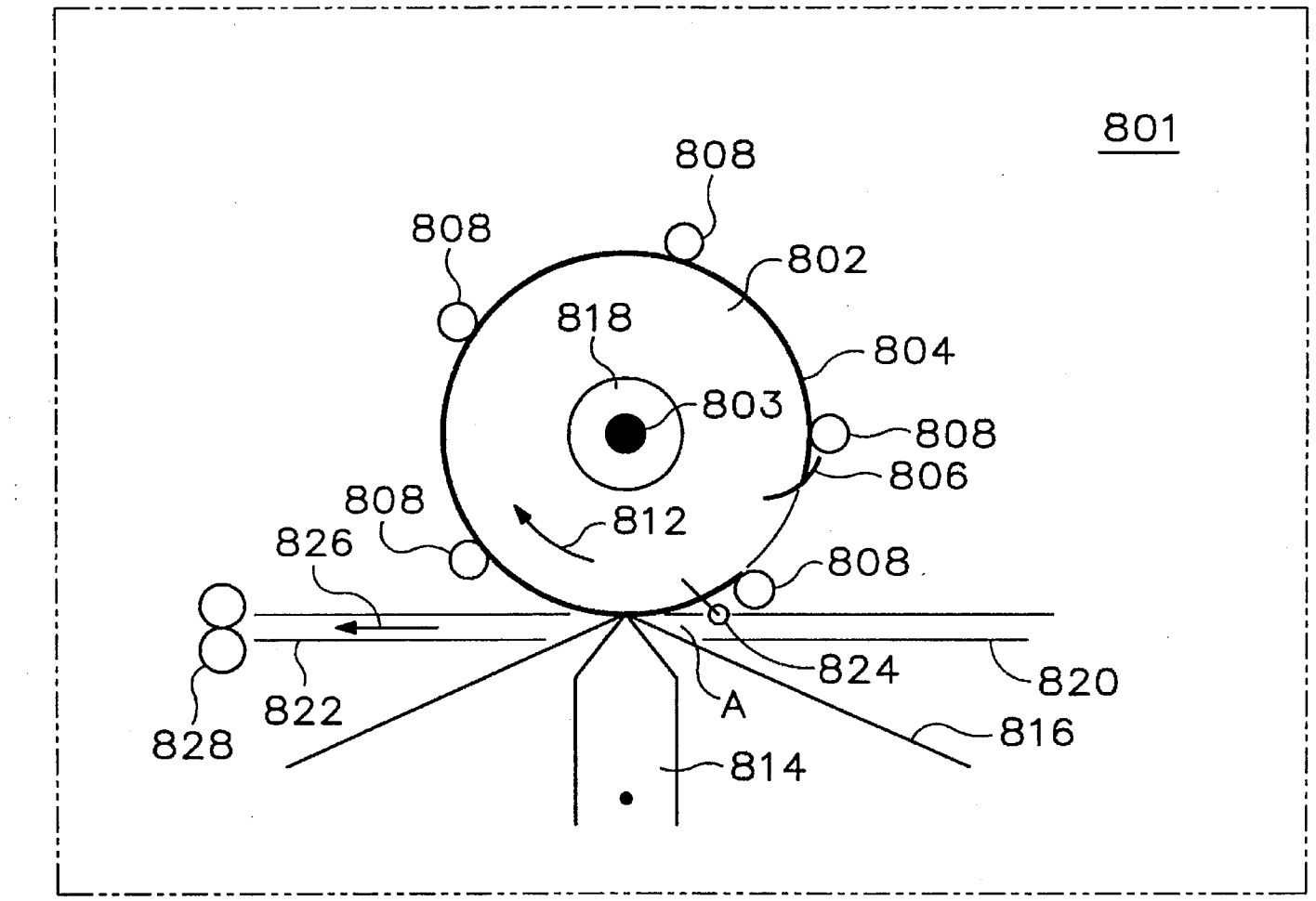
FIG. 8 shows in a side elevation schematic a drum means for controlling substrate movement.

FIG. 8 shows the use of a drum to control movement of a sheet of substrate. Specifically, drum system 800, which can be considered as replacing print head assembly 170 and first ribbon 102 of FIG. 1, is mounted to frame 801 and is structured around drum 802 which is rotatably mounted by shaft 803 to frame 801 through a motor (not shown). A sheet of substrate 804 is held onto drum 802 by clamp 806, which is recessed within drum 802 to avoid interference with the printing process but is shown exaggerated in FIG. 8. Spring-loaded rollers 808, which are rotatably attached to frame 801 and press against drum 802 about the circumference thereof, assist in keeping sheet 804 in place once sheet 804 has been grasped by clamp 806, as also does support roller 810 which is rotatably mounted to frame 801 immediately adjacent drum 802 and just past (to the left in FIG. 8) of printing point A. Upon such grasping by clamp 806, drum 802 rotates in the direction of arrow 812 (clockwise in FIG. 8) to advance sheet 804 forward so as eventually to reach the position wrapped around drum 802 shown in FIG. 8. (Though not shown in FIG. 8, there remains approximately ½ inch of gap between the leading and trailing edges of sheet 804 when so wrapped around drum 802.) While sheet 804 is being advanced past point A, print head 814 imparts energy to ribbon 816 so as to form an image on sheet 804. Drum system 800 further comprises first and second substrate guides 820, 822 which serve to guide sheet 804 up to and away from drum 802, respectively.

In operation, a sensor (not shown, but which can be of the same type as sensor 732 in FIG. 7) detects the presence of the leading edge of clamp 806, which holds the leading edge of sheet 804 so that printing by print head 814 can commence. A shaft encoder 818, which in this case is attached to shaft 803 upon which drum 802 is mounted instead of being attached to part of the substrate transport mechanism as in FIG. 7, monitors the forward rotation of drum 802. The system is instructed to commence counting from the first printable line, after a predetermined amount of rotation of drum 802 following the sensing of the edge of clamp 806. In order not to waste ribbon, however, print head 814 is not advanced towards ribbon 816 and sheet 804 until just before prining from a particular panel is to commence. Thus, e.g., if the first print line actually to be used for a yellow panel happens to be the 901st line, then print head 814 will be advanced forward by energizing a spring-loaded driver (not shown) in the usual manner as perhaps the 875th line is counted.

Drum system 800 provides an advantage over the substrate control mechanism of FIG. 7 in that once printing has begun within drum system 800, the substrate is not removed therefrom. That is, if a sheet 804 is initially printed upon throughout the length thereof using a yellow panel of ribbon 816, drum 802 is further rotated until the edge of clamp 806 is again sensed, and a second printing (e.g., using a magenta panel of ribbon 816) is similarly commenced after some predetermined degree of rotation of drum 802. This process can of course be followed by a third or fourth printing, etc., as desired and to the extent to which ribbon 816 incorporates additional panel types for such purposes. In each case, to avoid damage from collision with clamp 806 print head 814 is moved away from drum 802 during any process that brings clamp 806 near thereto.

After all such printing has been completed, release guide 824, which is rotatably attached to frame 801 near to drum 802 and on the same side thereof as is first substrate guide 820, is rotated under the trailing edge of sheet 804 and drum 802 is rotated in the direction opposite that of arrow 812 (i.e., counterclockwise in FIG. 8) so as to remove sheet 804 therefrom (i.e., to move sheet 804 in the direction opposite to that of arrow 826). As clamp 806 approaches release guide 824, sheet 804 is released therefrom. In so doing, the side of sheet 804 that was initially downward in FIG. 8 and thus becomes the side printed upon when placed on drum 402 still faces downward following such printing so as to be accessible to additional printing thereon at another location (e.g., at point D in FIG. 1). Sheet 804 is then urged forward within second substrate guide 822 by drum 802 and support roller 810, and is further urged forward by drive rollers 828, which are rotatably mounted to frame 801 and include a motor (not shown), towards such reprinting or for exit from the printer.

Figure 9:
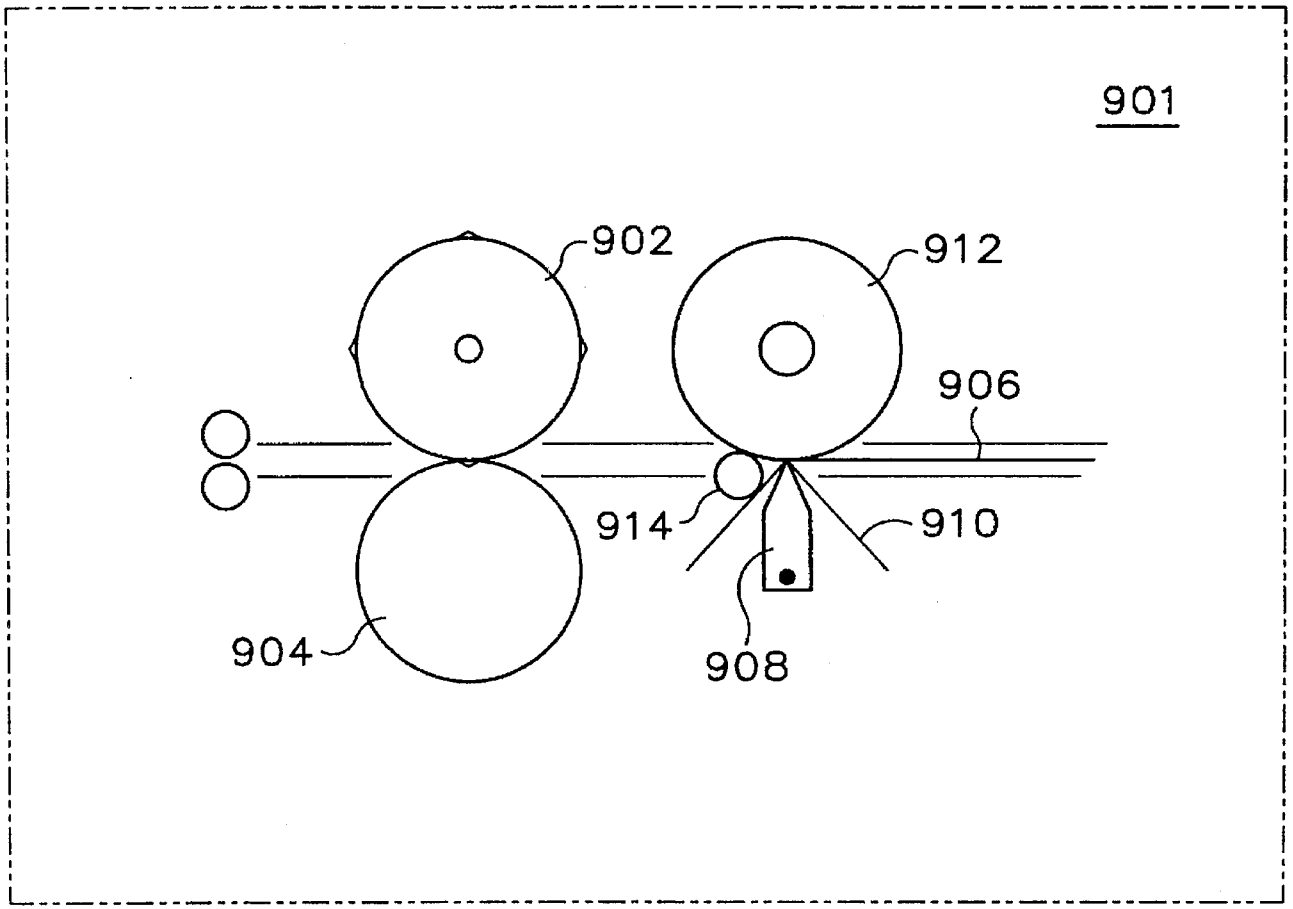
FIG. 9 shows in a side elevation schematic a grit roll means for controlling substrate movement.

Another substrate control mechanism that can be used in the present printer is depicted in FIG. 9, which shows a grit roll device that is particularly appropriate for use when the substrate is to be moved back and forth for multiple printing (e.g., as for y, m, c printing). Grit roll system 900, which can be taken as replacing print head assembly 170 and first ribbon 102 of FIG. 1, is mounted on printer frame 901 and is principally based upon the operation of grit roll 902 (shown in FIG. 9 with the grit greatly exaggerated) and facing roll 904, between which a sheet of substrate 906 is passed. Entry of sheet 906 between grit roll 902 and facing roll 904 causes small holes or indentations to be impressed into sheet 906, so that when sheet 906 is moved back and forth, the grits (small, sharp surface imperfections) of grit roll 902 tend to seek out those same indentations so that sheet 906 remains grasped as before. While printing on sheet 906 is occurring by means of print head 908, ribbon 910 and platen 912, impetus for urging sheet 906 forward is provided by a motor (not shown) that drives facing roll 904. Upon printing completely through sheet 906, the direction of rotation of facing roll 904 is reversed. At the same time, the trailing end of sheet 906 is held between platen 912 and a guide roller 914, so a motor (not shown) that drives platen 912 is also energized in that reverse direction and moves sheet 906 in that reverse direction while the edge of sheet 906 is still held by the grit roll. Upon the top of sheet 906 being readied for a second printing, sheet 906 will again be driven forward by grit roll 902 and facing roll 904 and, as noted above, the initial formation of small holes or indentations in sheet 906 tends to ensure good registration between printings. (During printing, platen 912 is idle.)

Generally, the ability provided by the invention to select a direct energy process, or one or more out of two or more ribbons (of which two are shown in FIG. 1 and three are shown in FIG. 6) for use at a time, presents advantages in conducting general printing operations. The different choices available lie as well in the types of ribbons that can be installed in printer 100. Some possible choices are shown in the following and in Table I:

EXAMPLE ONE

#1: Thermal transfer ribbon with repeating y, m, c 11 inch panels.

#2: Black thermal transfer ribbon.

Uses:

Printing up to 8.5×11 inch in black or color; use one or more of the y, m, C color set of ribbon #1 for highlight printing on a black image from ribbon #2.

Advantages:

Low cost 8.5×11 inch black and 8.5×11 inch color image capability; ability to do highlighting without manually changing ribbons; ability to do 8.5×11 inch black and an inserted 8.5×11 inch color image.

Disadvantages:

For printing small format color images, the unused portions of the large ribbon panels may be wasted unless marked and ribbon usage is recorded, since a smaller format y, m, c color ribbon would fulfill the requirements.

EXAMPLE TWO

#1: Thermal transfer ribbon with repeating y, m, c 33 inch panels.

#2: Black thermal transfer ribbon.

Advantages:

Low cost 8.5×11 inch black and full color image and highlighting capability; the unused portions of the panels will be longer and can be used for further full color imaging or highlighting.

Disadvantages:

The tooling costs are greater for the longer 33 inch color panels, and such longer panels also require more complex ribbon position marking and sensing.

EXAMPLE THREE

#1: A set comprising one 1000 inch yellow thermal transfer color panel and one 1000 inch blue thermal transfer color panel repeated three times.

#2: Black thermal transfer ribbon.

Advantages:

Permits printing of black and blue or yellow colors, and either or both of the blue and yellow highlight colors; two color image available by using the first ribbon in two passes (although this would require moving the ribbon about 1000 inches).

Disadvantages:

Full color printing is not available.

EXAMPLE FOUR

#1: A series of 11 inch y, m, c color panels repeated 100 times, and one 1000 inch color ther thermal transfer highlight color in yellow or red.

#2: Black thermal transfer ribbon.

Advantages:

Ribbon #1 can image highlight color onto a black text image from ribbon #2 or on a blank page; also provides low cost black imaging capability and full color imaging capability.

Disadvantages:

Either some of the y, m, c panels or portions of the highlight color panels may remain unused when the other panel type is used up and thus become wasted, but again marking the panels and recording ribbon usage will help avoid this waste.

EXAMPLE FIVE

#1: Thermal transfer ribbon with repeating y, m, c 11 inch panels.

#2: Dye diffusion ribbon with repeating y, m, c 11 inch panels.

Advantages:

The two types of full color printing are available at all times without need for manual changing of ribbons.

Disadvantages:

No black ribbon is installed, hence any black printing using the y, m, c panels is more expensive and takes more time.

EXAMPLE SIX

#1: Repeating set of 200 inch black and precoat thermal transfer panels.

#2: Repeating set of 11 inch y, m, c thermal transfer panels.

Advantages:

The precoat can be printed on plain paper by the first ribbon before the paper comes in front of the second ribbon for full color printing, and the first ribbon can also be used for printing black text. (When precoat is not required, ribbon #2 prints directly.)

Disadvantages:

Some of either the precoat or black panels may remain unused and wasted when the other is used up.

EXAMPLE SEVEN

#1: Repeating set of 11 inch precoat and y, m, c thermal transfer panels.

#2: Repeating set of 11 inch y, m, c thermal transfer panels.

Advantages:

Permits full color printing on plain paper using the precoat panels or on special paper without the precoat panels.

Disadvantages:

Printing black requires use of all three of the y, m, c panels which is both more expensive and time consuming.

EXAMPLE EIGHT

#1: Precoat ribbon.

#2: Repeating series of 30 11 inch y, m, c thermal transfer panels and one 1000 inch black thermal transfer panel repeated three times.

Advantages:

The precoat ribbon is relatively inexpensive and permits full color and black printing on plain paper when so required.

Disadvantages:

To print both full color and black requires winding of the ribbon after the one printing in order to bring the desired panels in front of the print head, hence doing just the one or the other provides more effective use of the ribbon.

The foregoing examples should be considered to be representative only and not exhaustive since a person of ordinary skill in the art, using the present disclosure as a basis, can easily conceive of other examples that may differ from those indicated in some detail but would not depart from the spirit and scope of the invention. Thus, just to present some other possibilities, the ribbons in any of examples one through five or nine through fifteen may also incorporate additional precoat panels to permit printing on a wider variety of plain paper; and in any of examples one through four and six through eleven, as also in the second ribbon of examples twelve and thirteen through fifteen, the ribbon can be of dye diffusion or other technology instead of thermal transfer. Also, any other example may, like example five, include both thermal transfer and dye diffusion technologies. All such ribbons, of course, may also incorporate the panel marking and panel usage procedures previously described.

| Embodiment | Ribbon | Description |
|---|---|---|
| 1 | #1 | Repeating series of y, m, c thermal transfer panels, each of which is 11 inches long. |
| | #2 | Black thermal transfer ribbon. Use: printing up to 8.5 × 11 inch black or color print; use one or more panels of the set of y, m, c panels for highlight printing on black image printed by the ribbon. Advantages: Low cost 8.5 × 11 inch black image and color image printing capability without changing ribbons. Disadvantages: For printing small format color images, the portion of the large ribbon panel is wasted (smaller format ribbon could have adequately done the print job in such imaging requirements). For printing small format color print, need to have means to use the unused ribbon portions. |
| 2 | #1 | Same as #1 except each color panels are 44 |
| | #2 | inch long with sequence numbers on each portion of panels or other means to use unused portion of panels. Advantages: Low cost 8.5 × 11 inch black image and full color and highlight printing capability as in #1; unused portion of panels are likely to be longer in this embodiment and therefore may be used for the next full color or highlight color image. Disadvantages: Tooling cost for longer panel is more expensive for 44 inch panels as compared to 11 inch panels; longer panels incorporate more complex ribbon marking and sensing; takes longer time to wind 44 inch panels when 11 inch color image is printed as compared to with 11 inch panels. (33 inch long panels can be used instead of 44 inch panels to reduce tooling cost). |
| 3 | | Black thermal transfer. (yellow thermal transfer 1000 inch + blue thermal transfer 1000 inch) × 3 times, means to use unused portions of panels. Advantages: black and black plus one of two or both highlight colors can be printed; two color image by printing with second ribbon in two passes. Disadvantages: full color capability is not available. |
| 4 | #1 | Black thermal transfer. |
| | #2 | Repeating series of y, m, c panels each 11 inch long 100 times + 1000 inch long yellow thermal transfer or red thermal transfer highlight color with means to use unused portions of ribbons. Advantage: The second ribbon can image one color highlight printing on a printed document printed by the first ribbon or on blank paper; low cost black imaging and color imaging capability; black and full color imaging inserted in black document capability. Disadvantage: Yellow or y, m, c set of panels may remain unused and wasted when the other panel is used up and therefore the ribbon is replaced. |
| 5 | #1 | Repeating series of y, m, c thermal transfer ribbon each panel is 11 inch long |
| | #2 | Repeating series of y, m, c Dye Diffusion Thermal Transfer technology ribbon; each panel is 11 inch long. Advantage: Two ribbons technologies are available to print at any time to give flexibility of printing without having to manually change the ribbons for thermal transfer printing or Dye Diffusion gray scale high quality printing. Disadvantage: Black ribbon is not installed and |

-continued

| Embodiment | Ribbon | Description |
|---|---|---|
| | | therefore black printing by the y, m, c panels is more expensive and takes more print time. |
| 6 | #1 | Repeating series of precoat, black thermal transfer panels each 200 inches long with means to use unused portions of panels. |
| | #2 | Repeating series of y, m, c thermal transfer panels each 11 inches long. Advantage: precoat and/or black can be printed by 1st ribbon before the paper comes in front of second ribbon for color or highlight printing; precoat and black panels are not automatically wasted when y, m, c ribbon is used up. Disadvantage: Precoat or black panels may remain unused and wasted when the other panel of the same ribbon is used up and therefore the ribbon is replaced. |
| 7 | #1 | Repeating series of precoat, y, m, c thermal transfer ribbon each panel is 11 inch long. |
| | #2 | Repeating series of y, m, c thermal transfer ribbon. Advantage: either printing on smooth paper without precoat or on rough surface with precoat can be printed; ribbon with precoat panel is used only when printing on rough surfaces. Disadvantage: Black image printing requires printing with all y, m, c panels and therefore is costly, highlight printing is expensive. |
| 8 | #1 | Precoat ribbon. |
| | #2 | (Repeating series of y, m, c thermal transfer series 30 panels + 1000 inch black thermal transfer) × 3 times with means to use unused portion of ribbon. Advantage: The paper can be printed with a precoat layer by 1st ribbon and then the second ribbon can print the colors and/or black image over precoat layer, inexpensive precoat roll of ribbon; precoat layer is used only when required. Disadvantages: Printing of color after black or vice versa image document requires winding the ribbon until the required other panels are brought in front of the print head ready for printing and this takes longer time for printing-thus this embodiment is more effective when there is a batch of print jobs which are all black or full color. |
| 9 | #1 | Black thermal transfer. |
| | #2 | Multi -print type 200 inch long panel of a highlight color such as yellow and a set of 100 11" long y, m, and c panels, with means to use the unused portions of panels. Advantages: Low cost black; full color capability; low cost highlight printing; low cost color highlight alphanumeric printing. Disadvantage: Multi print ribbon may not print consistent high quality printing. |
| 10 | #1 | Repeating series of y, m, c thermal transfer ribbon for dot modulation. |
| | #2 | Repeating series of y, m, c thermal transfer ribbon for 1 fixed size dot printing. Advantage: Higher quality color printing with many gray levels is possible as well as fixed size dot printing for less data. Disadvantage: Black printing is expensive. |
| 11 | #1 | No ribbon on one side so that special coated paper can be printed with direct thermal printing. |
| | #2 | Repeating series of 11" long y, m, c thermal transfer panels. Advantages: Direct printing is possible for special coated paper. Disadvantage: Direct coating does not print on plain paper. |
| 12 | #1 | 8.5 inch wide thermal transfer ribbon which comprises 0.5 inch wide thermal transfer magnetic ink for character recognition and rest of the panel with black color. |
| | #2 | 8.0 inch wide conventional ribbon y, m, c thermal transfer (repeating 11 inch panels) Advantages: Documents like checks can be printed in one pass both magnetic as well black printing in the selected area. Disadvantages: Magnetic ink coating is wasted when image does not require magnetic coating. |
| 13 | #1 | Black Thermal Transfer ribbon. |
| | #2 | Blue Thermal Transfer Advantages: Black or Blue image as well as black and blue image can be printed. Disadvantage: Full color printing is not possible. |
| 14 | #1 | Replenishing type black thermal transfer ribbon. |
| | #2 | Repeating series of y, m, c thermal transfer panels of 11 inch long. Advantages: Low cost black printing because the thermal transfer layer can be replenished. Disadvantages: Printer is more costly due to the cost for replenishing ink sub-system. |
| 15 | #1 | Black thermal transfer ribbon |
| | #2 | Repeating series of y, m c thermal transfer panels of 11 inches long with means to use the unused portions of panels. Advantages: Black, full color letter size and small format color image can be printed economically. Disadvantages: Need Read Head to read sequence numbers for |

NOTES: The above ribbon embodiments can be changed to optimize print job and some of the example to change are as follows:

Note #1: Embodiment #1 to #5, 9, 10, 11, 12, 13, 14 and 15 can incorporate precoat panels in addition to y, m, c and/or black to enable printing on on wider variety of plain paper.

Note #2: In embodiments 1, 2, 3, 4, 6, 7, 8, 9, 10, 11, #2 ribbon of 12, 13, 14 and 15 Dye Diffusion Thermal Transfer or any other technology for the ribbon can be used instead of one or both ribbons of thermal transfer shown in the table.

Note #3: Panel number and portion of panels can be marked or means is provided so that unused portion of panels can be used.

Note #4: Some of the panels can incorporate magnetic ink for character recognition.

Note #5: Some of the panels can have mutliprint capability to enable printing more than one print by the ribbon.

Note #6: Ribbon can be replenishing type so that a replenishing subsystem can replenish one or more ribbons.

Note #7: Marks can be on the printing area of the ribbon.

With regard to the printer structure, it will also be understood that departures may be made from the precise structure shown in the figures, e.g., the configuration may be such that the structures near points C and D in FIG. 1 are oriented not 180 degrees apart, but at some smaller angle such that print head assembly 170, 200 or 500 is set to one side thereof while still remaining accessible thereto. Similarly, one may use the known procedure in which an image is first transferred to a drum and is then copied onto paper (which would use one or the other paper transfer process). None of such variations as would be attainable to a person of ordinary skill in the art on the basis of the present disclosure would depart from the spirit and scope of the invention, which are to be taken only from the claims which follow, and from the equivalents thereof.

I claim:

1. A non-impact printer comprising:

supply means for supplying a first image-receiving substrate;

one thermal printhead;

at least two ribbons, each ribbon disposed for transferring an image to the substrate in cooperation with the printhead;

a first one of the ribbons comprised of, in combination, an ink, means for releasing the ink, and means for adhering the ink to the substrate in a thermal transfer process for transferring the image to the substrate;

a second one of the ribbons comprised of dye diffusion type of transfer materials for transferring the image to the substrate using a sublimation process;

at least one of the ribbons includes multiple color panels; and selection means for positioning the printhead into cooperative juxtaposition with a selected one at a time of said at least two ribbons for transferring the image to the substrate, thereby permitting printing with either a thermal transfer or a dye diffusion process within a single printer without changing ribbons.

2. A printer according to claim 1 wherein said multiple color panels include repeating sets of cyan, magenta and yellow color panels.

3. A printer according to claim 1 wherein said multiple color panels include repeating sets of cyan, magenta, yellow and black thermal transfer materials.

4. A printer according to claim 1 wherein said multiple color panels include repeating sets of at least one color and precoat thermal transfer materials.

5. A printer according to claim 1 wherein at least two of said ribbons each include multiple color panels.

6. A printer according to claim 1 wherein at least one of the ribbons includes a precoat panel.

7. A printer according to claim 1 wherein said multiple color panels include repeating panels of cyan, magenta, yellow and precoat thermal transfer materials.

8. A primer according to claim 1 wherein at least one of the ribbons comprises essentially a continuous panel of precoat material.

9. A printer according to claim 1 wherein one of said ribbons has a first width and at 1east one other ribbon has a selected width narrower than the first width.

10. A printer according to claim 1 wherein said selection means includes means repositioning a selected one of the ribbons into cooperative juxtaposition with the printhead for printing.

11. A printer according to claim 1 wherein said selection means includes means for translation of the printhead into cooperative juxtaposition with a selected one of the ribbons for printing.

12. A printer according to claim 1 wherein said selection means includes means for rotating the printhead into cooperative juxtaposition with a selected one of the ribbons for printing.

13. A printer according to claim 1 wherein at least one of the ribbons includes a precoat panel and the other ribbon comprises dye diffusion color panels.

14. A printer according to claim 1 wherein said multiple color panels include repeating sets of cyan, magenta, yellow and multiprint black panels.

15. A printer according to claim 1 wherein at least one of the ribbons includes multiple color panels and another one of the ribbons comprises essentially black transfer material.

16. A printer according to claim 1 wherein at least one of the ribbons includes two different color panels and another one of the ribbons comprises essentially black transfer material.

* * * * *